US005957554A

United States Patent [19]

Pendergast

[11] Patent Number: 5,957,554

[45] **Date of Patent: *Sep. 28, 1999**

[54] HUMIDIFIERS

[76] Inventor: James C. Pendergast, 3136 Terrace High, Racine, Wis. 53406

[ * ] Notice: This patent issued on a continued prosecution application filed under 37 CFR 1.53(d), and is subject to the twenty year patent term provisions of 35 U.S.C. 154(a)(2).

[21] Appl. No.: 08/893,383

[22] Filed: Jul. 11, 1997

[51] Int. Cl.[6] ..... A24F 25/00

[52] U.S. Cl. ..... 312/31; 131/300; 131/302; 261/99; 261/104

[58] Field of Search ..... 131/302, 300; 312/31; 261/99, 104, 107; 206/213.1

[56] References Cited

U.S. PATENT DOCUMENTS

| | | | |
|---|---|---|---|
| 1,983,691 | 12/1934 | Bonardi | 312/31 |
| 3,336,093 | 8/1967 | Phelps | 312/31.1 |
| 3,431,038 | 3/1969 | Berliner | 312/31 |
| 4,428,892 | 1/1984 | Bekiner | 261/99 |

FOREIGN PATENT DOCUMENTS

| | | |
|---|---|---|
| 931149 | 2/1948 | France . |
| 2402164 | 3/1979 | France . |
| 2446454 | 8/1980 | France . |

*Primary Examiner*—John G. Weiss
*Assistant Examiner*—Charles W. Anderson
*Attorney, Agent, or Firm*—Hill & Simpson

[57] ABSTRACT

The present invention provides humidifiers for use in maintaining tobacco at desired levels of humidity. The humidifier includes a humidifier tank having a reservoir chamber fluidly connected to a pair of evaporation chambers by a pair of capillary tubes having a fluid passageway. Evaporation media is contained within the evaporation chambers. A pair of shutters having shutter openings are adjustably mounted on the evaporation chambers to open and close front evaporation openings in the evaporation chambers. Rear evaporation openings are also provided on the evaporation chambers which are continuously open. The humidifying fluid evaporates from the evaporation media in the evaporation chambers through the front and rear evaporation openings to humidify the tobacco environment. A fluid level indicator on the humidifier permits the fluid level in the humidifier to be monitored and the humidifier to be refilled as needed.

20 Claims, 2 Drawing Sheets

HUMIDIFIERS

FIELD OF THE INVENTION

The present invention generally relates to humidifiers and more specifically, the present invention relates to humidifiers used to maintain desired levels of humidity for tobacco, such as cigars.

BACKGROUND OF THE INVENTION

Many people enjoy smoking tobacco, for example cigars. The popularity of smoking tobacco has increased which increases the demand for tobacco. Tobacco is smoked for various reasons, such as experiencing the enjoyable sensations of the tobacco smoke, socializing, business situations, as a symbol of one's success, and for other reasons. Tobacco smokers, whether an occasional smoker or a tobacco enthusiast, appreciate quality tobacco.

Tobacco is grown worldwide and each tobacco may provide its own unique characteristics. The enjoyable flavors and aromas of tobacco can vary significantly or only very slightly from one tobacco to another. However, many, if not all tobaccos, particularly quality tobaccos used to make fine cigars, should be stored at proper humidity levels. Tobacco which is not maintained at a proper humidity level may tend to loose its desired flavors and aromas and may not be as enjoyable when smoked. Also, tobacco maintained at too low a level of humidity may tend to dry out and can easily crack.

Tobacco is typically stored in a humidified environment to maintain the tobacco at proper humidity levels. Various devices have been used to store tobacco in humidified environments, such as humidors, display cases and humidified rooms. The humidified environments need a mechanism to provide moisture in the surrounding air to maintain proper humidity.

SUMMARY OF THE INVENTION

The present invention provides new humidifiers for use in maintaining tobacco, such as cigars, at desired levels of humidity. The humidifiers provide moisture to the environment surrounding the tobacco to assist in ensuring the tobacco maintains its qualities and can be thoroughly enjoyed when smoked.

One humidifier according to the present invention includes a humidifier tank having a reservoir chamber fluidly connected to a pair of evaporation chambers by a pair of capillary tubes having a fluid passageway. Evaporation media is contained within the evaporation chambers. A pair of shutters having shutter openings are adjustably mounted on the evaporation chambers to open and close (fully or partially) front evaporation openings. Rear evaporation openings are also provided on the evaporation chambers which may be continuously open. If desired the rear openings may also be coverable by the shutter or other blocking device. Humidifying fluid is added to the fluid reservoir through a closeable refill opening and travels through the capillary tubes to the evaporation chambers and the evaporation media. The humidifying fluid evaporates from the evaporation media in the evaporation chambers through the front and rear evaporation openings to humidify the tobacco environment. The humidifying fluid may be water, distilled water or special fluid for humidifying tobacco, for example. A fluid level indicator on the humidifier permits the fluid level in the humidifier to be monitored and the humidifier to be refilled as needed.

The new humidifiers are particularly suited for use in tobacco containers, such as humidors and display cases. The humidifiers provide a convenient, cost effective way of maintaining tobaccos at proper humidity levels. The humidifiers are adjustable so that the level of humidity can be controlled and the humidifiers are easy to operate.

Therefore, an advantage of the present invention is to provide humidifiers used to maintain desired levels of humidity for tobacco, such as cigars.

Another advantage of the present invention is to provide a tobacco humidifier which is adjustable to regulate the amount of humidity provided by the humidifier.

Another advantage of the present invention is to provide a humidifier having a humidifier tank which has a reservoir chamber fluidly connected to an evaporation chamber by a fluid passage way, the reservoir chamber having a fluid refill opening in the evaporation chamber defining an evaporation opening; evaporation media contained within the evaporation chamber; a shutter having a shutter opening, the shutter adjustably mounted on the humidifier tank wherein the shutter opening and the evaporation opening are at least partially alignable with each other; and a cap removably closing the fluid refill opening of the reservoir chamber.

Other objects and advantages of the present invention will become apparent upon reading this disclosure including the appendant claims and with reference to the accompanying drawings.

DETAILED DESCRIPTION OF PRESENTLY PREFERRED EMBODIMENTS

Although the present invention can be made in many different forms, the presently preferred embodiments are described in this disclosure and shown in the attached drawings. This disclosure exemplifies the principles of the present invention and does not limit the broad aspects of the invention only to the illustrated embodiments.

Figure 1:
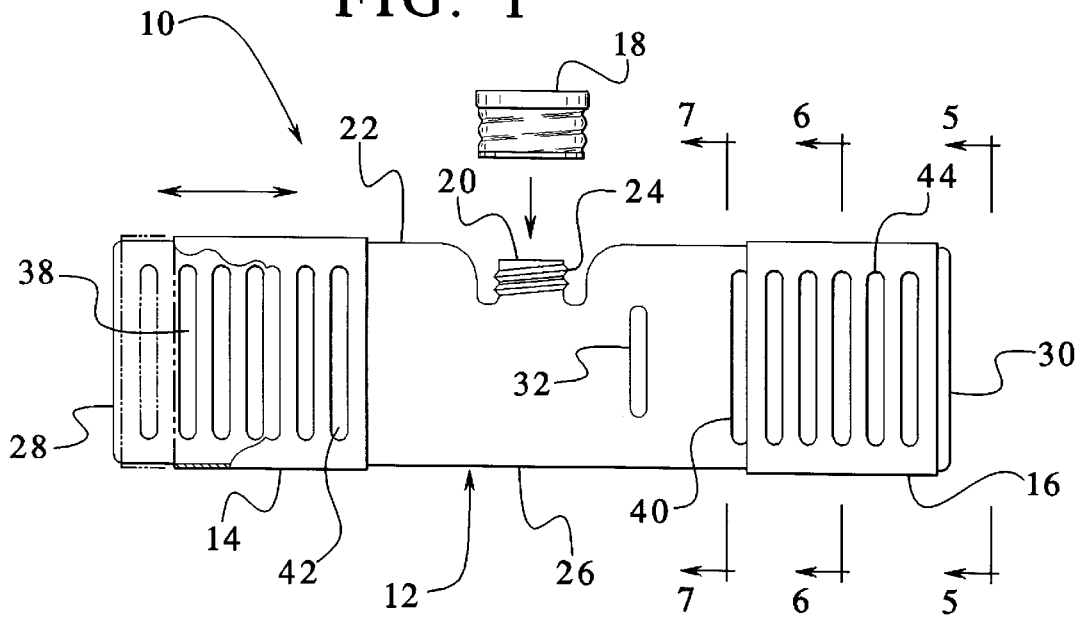
FIG. 1 is a front elevational view of a humidifier according to the principles of the present invention.

A new humidifier 10 according to the principles of the present invention for use in maintaining tobacco, such as cigars, at proper humidity is shown by way of example in FIG. 1. The humidifier 10 includes a humidifier tank 12 and two shutters 14, 16 slidably positioned on opposite ends of the humidifier tank 12. A cap 18 is provided for closing and opening a refill opening 20 on a top 22 of the humidifier tank 12. The refill opening 20 is defined by a threaded neck 24 which is recessed below the top 22 of the humidifier tank 12. The neck 24 is recessed below the top 22 such that when the cap 18 is on the neck 24, the top of the cap 18 is about even with the top 22. This provides the humidifier 10 with a lower profile and a stream-lined appearance. The humidifier tank 12 includes a fluid reservoir 26 positioned between two evaporation chambers 28, 30. The fluid reservoir 26 holds a supply of humidifying fluid which passes to the evaporation chambers 28, 30 as needed. As the humidifying fluid evaporates from the evaporation chambers 28, 30, the fluid in the evaporation chambers 28, 30 is replenished from the fluid in the reservoir chamber 26.

A fluid level indicator 32 is provided on the humidifier tank 12 to determine the level of fluid in the fluid reservoir 26. The fluid level indicator 32 permits the level of fluid in the humidifier tank 12 to be viewed so that the fluid reservoir 26 can be re-filled with fluid as needed. A portion of the front of the humidifier tank 12 has a reduced material thickness which forms the fluid level indicator 34. Other ways of monitoring or viewing the fluid level in the humidifier tank 12 could also be utilized, for example a transparent window covering an opening in the humidifier tank 12.

Figure 3:
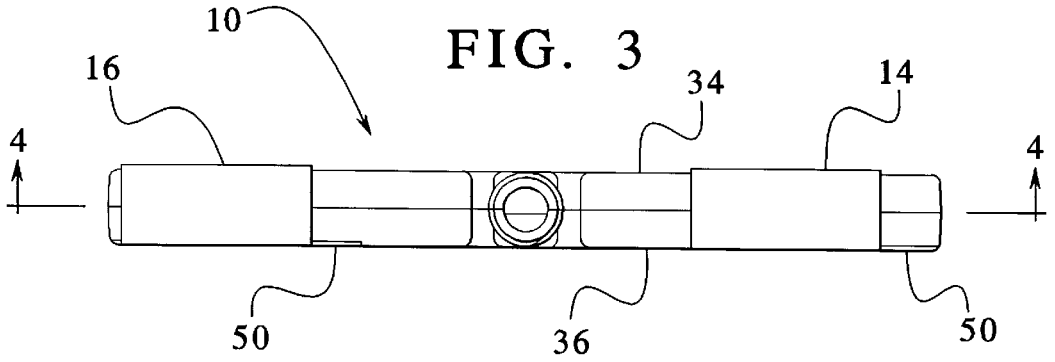
FIG. 3 is a top view of the humidifier of FIG. 1.

The humidifier tank 12 is formed from a plastic front plate 34 and a plastic back plate 36 (FIG. 3) which are welded together. As shown in FIG. 1, the front plate 34 defines front evaporation openings 38, 40 in the evaporation chambers 28,30. The front evaporation openings 38, 40 include a plurality of elongated, vertical slots through the front walls of the evaporation chambers 28, 30. The shutters 14, 16 are C-shaped and define shutter openings 42, 44 which are formed by a plurality of elongated slots though the shutters 14, 16. Fluid leaves the humidifier 10 through the front evaporation openings 38, 40 in the evaporation chambers 28, 30 and through the shutter openings 42, 44 in the shutters 14, 16 by evaporation to humidify tobacco. Various types of evaporation and shutter openings are contemplated by this invention, for example, the size, shape and number of evaporation and shutter openings could be varied. Further, various types of shutter openings 42, 44 (which may or may not have the same size and shape as the front evaporation openings 38, 40) can also be utilized. The C-shaped shutters 14, 16 are made from stainless steel material which resists corrosion.

Figure 2:
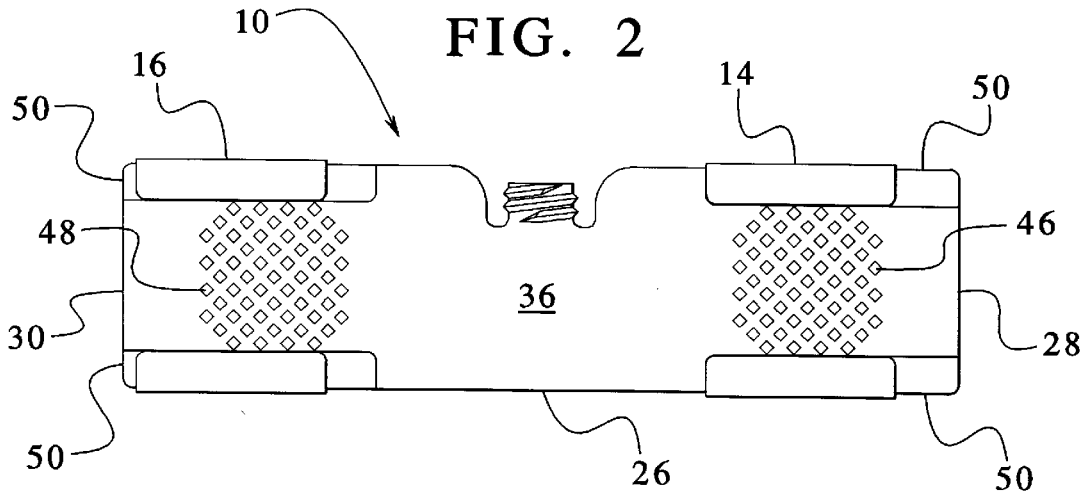
FIG. 2 is a rear elevational view of the humidifier of FIG. 1.
Figure 6:
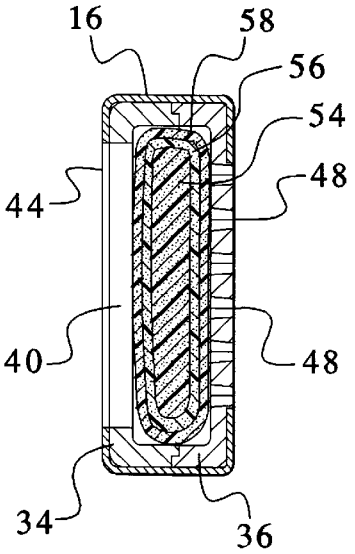
FIG. 6 is a cross-sectional view of the humidifier along the line 6—6 of FIG. 1.

Referring to FIG. 2, the back plate 36 has rear evaporation openings 46, 48 on the evaporation chambers 28, 30. The rear walls of the evaporation chambers 28, 30 have a plurality of diamond shaped holes which define the rear evaporation openings 46, 48. The rear evaporation openings 46, 48 are continuously open to provide fluid evaporation from the humidifier 10. Although, a mechanism which adjustably opens and closes the rear evaporation openings 46, 48 could be provided with the humidifier 10. As shown in FIG. 6, the rear evaporation openings 46, 48 are tapered from a larger opening on the inside of the humidifier 10 to a relatively smaller opening on the outside of the humidifier 10. Various types of rear evaporation openings 46, 48 are contemplated by this invention, for example, the size, shape and number of evaporation openings could be varied, such as elongated slots similar to the front evaporation openings 38, 40, for example.

The back plate 36 also includes recesses 50 as shown in FIG. 2. The C-shaped shutters 14, 16 are adjustably mounted on the evaporation chambers 28, 30 by wrapping around the top and bottom of the humidifier tank 12 and sliding within the recesses 50. The shutters 14, 16 slide within the recesses 50 to vary the size of the front evaporation openings 38, 40 which adjusts the level of humidity produced by the humidifier 10 as discusses in more detail below.

Figure 4:
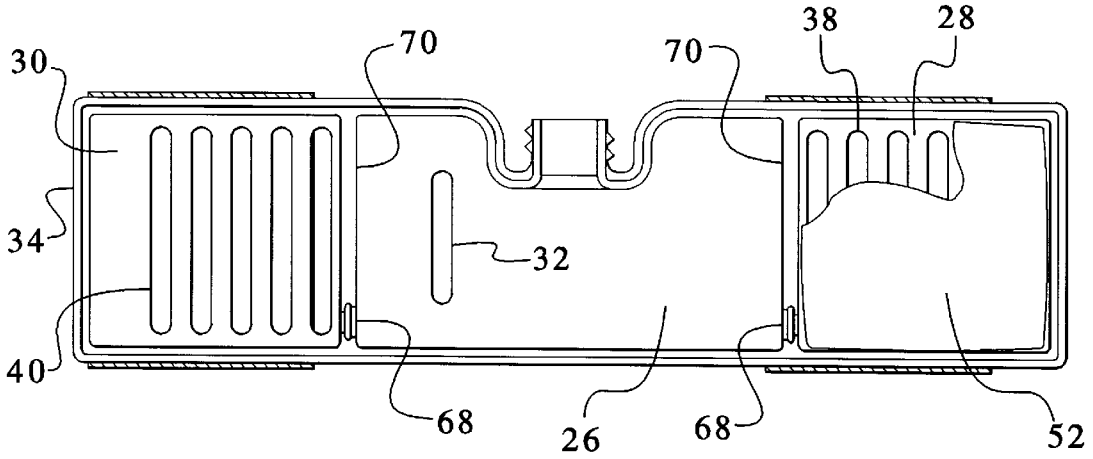
FIG. 4 is a cross-sectional view of the humidifier along the line 4—4 of FIG. 3.
Figure 5:
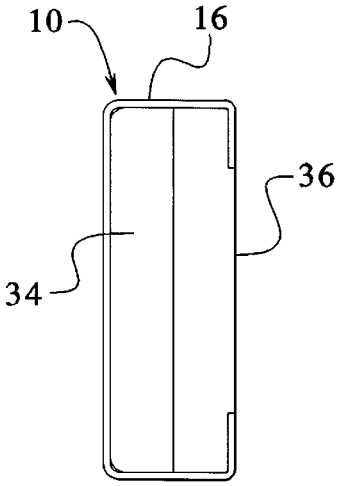
FIG. 5 is an end view of the humidifier of FIG. 1 along the line 5—5.

One evaporation media 52 is contained in each of the evaporation chambers 28, 30. FIG. 4 shows a partial view of the evaporation media 52 in one evaporation chamber 28 and FIG. 6 shows a cross-sectional view of the evaporation media 52. The evaporation media 52 holds the humidifying fluid so that the fluid can evaporate from the humidifier 10 through the front and rear evaporation openings 38, 40, 46, 48 without leaking out of the humidifier 10. One evaporation media 52 useable with the humidifier 10 is a three layer media available from 3M. Referring to FIG. 6, the three layer evaporation media 52 includes a core of HME media 54 surrounded by a layer of yellow Powersorb 56. The layer of yellow Powersorb 56 is surrounded by an outer layer of hydrophobic Coverweb 58, all available from 3M. Powersorb and Coverweb may be trademarks of 3M.

Figure 7:
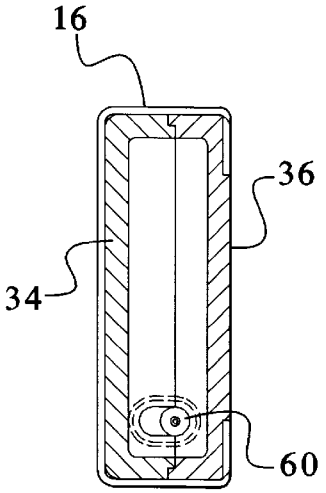
FIG. 7 is a cross-sectional view of the humidifier along the line 7—7 of FIG. 1.
Figure 8:
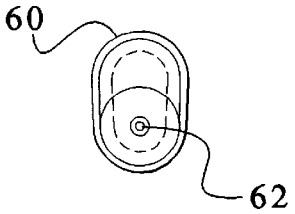
FIG. 8 is an end elevational view of a capillary tube used in the humidifier of FIG. 1.
Figure 9:
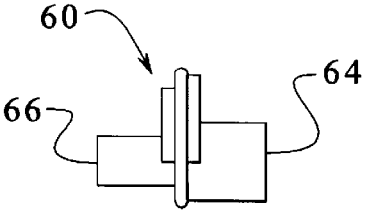
FIG. 9 is a side elevational view of the capillary tube of FIG. 8.
Figure 10:
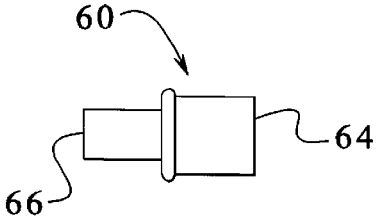
FIG. 10 is another side elevational view of the capillary tube of FIG. 8.

The humidifier 10 also includes a pair of capillary tubes 60 in which one of the capillary tubes 60 is shown in FIGS. 9-10. The capillary tube 60 has a capillary 62 extending through the capillary tube 60 to permit controlled flow of fluid through the capillary tube 60. The capillary 62 is tapered from a larger opening at a reservoir end 64 to a relatively smaller opening at an evaporation chamber end 66. The capillary tubes 60 are secured within capillary tube recesses 68 in walls 70 which separate the evaporation chambers 28, 30 from the fluid reservoir 26. A portion of each of the capillary tube recesses 68 is shown in the front plate 34 in FIG. 4, and the rear plate 36 also defines a portion of each of the capillary tube recesses 68 as can be seen in FIG. 7. The capillary tube recesses 68 and the capillary tubes 60 are designed to cooperate with each other so that the reservoir ends 64 face the reservoir 26 and the evaporation chamber ends 66 face the evaporation chambers 28, 30. Accordingly, the capillary tubes 60 provide fluid passageways between the fluid reservoir 26 and the evaporation chambers 28, 30.

The humidifier 10 is operated as follows. The cap 18 is removed from the neck 24 to open the refill opening 20. Humidifying fluid, such as water for example, is added to the fluid reservoir 26 until the desired fluid level is obtained as can be seen through the fluid level indicator 32. The cap 18 can be placed back on the neck 24 to close the refill opening 20. The humidifying fluid passes from the fluid reservoir 26 through the capillary tubes 60 to the evaporation chambers 28, 30 and into the evaporation media 52 in the evaporation chambers 28, 30. The position of the shutters 14, 16 on the evaporation chambers 28, 30 are adjusted to open or close (partially or fully) the evaporation openings 38, 40 as desired. The evaporation openings 38, 40 are opened and closed by sliding the shutters 14, 16 to align or offset the evaporation openings 38, 40 with the shutter openings 42, 44. Each one of the shutters 14, 16 can be individually adjusted to their respective positions and adjusted to partially or fully open and close the evaporation openings 38, 40.

The humidifying fluid evaporates from the evaporation media 52 through the front and rear evaporation openings 38, 40, 46, 48 in the evaporation chambers 28, 30 into the area surrounding the humidifier 10. As the humidifying fluid evaporates, the fluid level decreases which can be monitored via the fluid level indicator 32. The humidifier 10, particularly the fluid reservoir 26, is refilled as needed. In this manner, the humidifier 10 provides moisture in the air to maintain tobacco at a desired humidity level. For example, the humidifier 10 can be used in a cigar display case to store many cigars at the desired amount of humidity.

While the presently preferred embodiments have been illustrated and described, numerous changes and modifications can be made without significantly departing from the spirit and scope of this invention. Therefore, the inventor intends that such changes and modifications are covered by the appended claims.

The invention is claimed as:

1. A humidifier comprising:

a humidifier tank having a reservoir chamber fluidly connected to an evaporation chamber by a fluid passageway, the reservoir chamber having a fluid refill opening and the evaporation chamber defining an evaporation opening, the evaporation chamber having a linear sliding surface;

evaporation media contained within the evaporation chamber;

a shutter having a shutter opening, the shutter adjustably mounted on the humidifier tank and linearly slidable on the linear sliding surface of the evaporation chamber wherein the shutter opening and the evaporation opening are at least partially alignable with each other; and a cap removably closing the fluid refill opening of the reservoir chamber.

2. The humidifier of claim 1 further comprising:

a pair of evaporation chambers positioned on opposite ends of the reservoir, each one of the evaporation chambers fluidly connected to the reservoir by a fluid passageway; and a pair of shutters, each one of the shutters adjustably mounted to the humidifier tank adjacent one of the evaporation chambers.

3. The humidifier of claim 2 wherein each fluid passageway is a capillary tube.

4. The humidifier of claim 2 wherein each of the evaporation chambers has a back wall opposite a front wall, the back wall defining a plurality of back wall evaporation openings and the front wall defining a plurality of front wall evaporation openings, each shutter positioned adjacent the front wall evaporation openings.

5. The humidifier of claim 2 wherein the shutters have a C-shape in cross-section.

6. The humidifier of claim 1 wherein the fluid passageway is a capillary tube.

7. The humidifier of claim 1 further comprising a fluid level indicator on the reservoir chamber.

8. The humidifier of claim 7 wherein the fluid level indicator comprises a reduced material thickness in a wall of the reservoir chamber.

9. The humidifier of claim 1 wherein the evaporation chamber has a back wall opposite a front wall, the back wall defining a plurality of back wall evaporation openings and the front wall defining a plurality of front wall evaporation openings, the shutter positioned adjacent the front wall evaporation openings.

10. The humidifier to claim 1 wherein the shutter has a C-shape in cross-section.

11. A tobacco humidifier comprising:

a humidifier tank having a reservoir chamber and first and second evaporation chambers, the reservoir chamber fluidly connected to the first and second evaporation chambers by first and second fluid passageways, respectively, the reservoir chamber having a fluid refill opening, each of the first and second evaporation chambers defining an evaporation opening;

a first evaporation media contained within the first evaporation chamber and a second evaporation media contained within the second evaporation chamber;

a first shutter adjacent the first evaporation chamber and linearly movable relative to the first evaporation opening; and a second shutter adjacent the second evaporation chamber and linearly movable relative to the second evaporation opening;

wherein the first and second evaporation openings are variably covered and uncovered by their respective first and second shutters.

12. The tobacco humidifier of claim 11 wherein each of the evaporation openings comprise a plurality of evaporation openings.

13. The tobacco humidifier of claim 12 wherein each of the first and second shutters define a plurality of shutter openings.

14. The tobacco humidifier of claim 11 wherein each of the first and second evaporation chambers further define a plurality of continuously open evaporation openings.

15. The tobacco humidifier of claim 11 wherein the reservoir chamber is positioned at a generally mid-section of the humidifier tank and the first and second evaporation chambers are positioned adjacent the reservoir chamber at opposite ends of the humidifier tank.

16. The tobacco humidifier of claim 11 further comprising first and second capillary tubes which define the first and second fluid passageways, respectively.

17. The tobacco humidifier of claim 11 wherein the first and second shutters are slidably positioned on an outside portion of their respective first and second evaporation chambers.

18. A cigar humidifier comprising:

a fluid reservoir having a fluid refill opening;

a first evaporation chamber fluidly connected to the fluid reservoir by a first fluid passageway, the first evaporation chamber defining a plurality of continuously open evaporation openings and a plurality of adjustable evaporation openings;

a second evaporation chamber fluidly connected to the fluid reservoir by a second fluid passageway, the second evaporation chamber defining a plurality of continuously open evaporation openings and a plurality of adjustable evaporation openings;

a first evaporation media positioned in the first evaporation chamber;

a second evaporation media positioned in the second evaporation chamber;

a first shutter defining a plurality of first shutter openings and linearly slidably positioned on the first evaporation chamber with the plurality of first shutter openings adjacent the plurality of adjustable evaporation openings of the first evaporation chamber; and a second shutter defining a plurality of second shutter openings and linearly slidably positioned on the second evaporation chamber with the plurality of second shutter openings adjacent the plurality of adjustable evaporation openings of the second evaporation chamber.

19. The cigar humidifier of claim 18 wherein the plurality of adjustable evaporation openings of the first and second evaporation chambers comprise elongated slots.

20. A method of humidifying tobacco comprising the steps of:

placing fluid in a refillable fluid reservoir;

passing a first portion of the fluid from the fluid reservoir to a first evaporation media in a first evaporation chamber;

passing a second portion of the fluid from the fluid reservoir to a second evaporation media in a second evaporation chamber;

adjusting the size of a first evaporation opening on the first evaporation chamber by linearly sliding a first shutter on the first evaporation chamber;

adjusting the size of a second evaporation opening on the second evaporation chamber by linearly sliding a second shutter on the second evaporation chamber;

permitting the first portion of fluid to evaporate from the first evaporation media through the first evaporation opening; and permitting the second portion of fluid to evaporate from the second evaporation media through the second evaporation opening.

* * * * *